US011377989B2

(12) United States Patent
Hörr et al.

(10) Patent No.: US 11,377,989 B2
(45) Date of Patent: Jul. 5, 2022

(54) MUFFLER

(71) Applicant: Eberspächer Exhaust Technology GmbH & Co. KG, Neunkirchen (DE)

(72) Inventors: Micha Hörr, Schorndorf (DE); Konrad Klausa, Deizisau (DE)

(73) Assignee: PUREM GMBH, Neunkirchen (DE)

( * ) Notice: Subject to any disclaimer, the term of this patent is extended or adjusted under 35 U.S.C. 154(b) by 722 days.

(21) Appl. No.: 16/250,496

(22) Filed: Jan. 17, 2019

(65) Prior Publication Data

US 2019/0226371 A1 Jul. 25, 2019

(30) Foreign Application Priority Data

Jan. 22, 2018 (DE) ..... 10 2018 101 254.3
Feb. 26, 2018 (DE) ..... 10 2018 104 239.6

(51) Int. Cl.

| | |
|---|---|
| ***F01N 1/00*** | (2006.01) |
| ***F01N 1/08*** | (2006.01) |
| ***F01N 1/02*** | (2006.01) |
| ***F01N 1/16*** | (2006.01) |
| ***G10K 11/16*** | (2006.01) |

(Continued)

(52) U.S. Cl.

CPC ..... *F01N 1/006* (2013.01); *F01N 1/02* (2013.01); *F01N 1/083* (2013.01); *F01N 1/084* (2013.01); *F01N 1/163* (2013.01); *F01N 1/166* (2013.01); *F01N 13/1855* (2013.01); *G10K 11/161* (2013.01); *G10K 11/162* (2013.01); *F01N 2470/10* (2013.01); *F01N 2470/24* (2013.01); *F01N 2490/02* (2013.01); *F01N 2490/06* (2013.01); *F01N 2490/08* (2013.01)

(58) Field of Classification Search

CPC . F01N 1/006; F01N 1/02; F01N 1/083; F01N 1/084; F01N 1/163; F01N 1/166; F01N 13/1855; F01N 2470/10; F01N 2470/24; F01N 2490/02; F01N 2490/06; F01N 2490/08; G10K 11/162; G10K 11/161

USPC ..... 181/228, 237

See application file for complete search history.

(56) References Cited

U.S. PATENT DOCUMENTS 8,579,077 B2 * 11/2013 Ahn ..... F01N 1/026 181/256
9,617,882 B1 * 4/2017 Horr ..... F01N 1/163

(Continued)

FOREIGN PATENT DOCUMENTS

AU 6456394 A 12/1994
CN 105164381 A 12/2015

(Continued)

*Primary Examiner* — Forrest M Phillips

(74) *Attorney, Agent, or Firm* — McGlew and Tuttle, P.C.

(57) ABSTRACT

A muffler for an exhaust system of an internal combustion engine includes a muffler housing (14) and at least one exhaust gas pipe group (19). The at least one exhaust gas pipe group (19) includes an outlet pipe (20) open towards an expansion chamber (26) formed in the muffler housing (14). Exhaust gas introduced via the at least one exhaust gas pipe group (19) leaves the muffler housing (16) via the outlet pipe (20). A first inlet pipe (38), of the at least one exhaust gas pipe group (19), has an inlet pipe end area (40), which is inserted into the outlet pipe (20) and extends in the outlet pipe (20). A second inlet pipe (48), of the at least one exhaust gas pipe group (19), is open towards the expansion chamber (26).

20 Claims, 3 Drawing Sheets

(51) Int. Cl.
*F01N 13/18* (2010.01)
*G10K 11/162* (2006.01)

(56) References Cited

U.S. PATENT DOCUMENTS

| | | | | |
|---|---|---|---|---|
| 10,823,022 | B2 * | 11/2020 | Soatti | F01N 1/083 |
| 11,002,165 | B2 * | 5/2021 | Poulin | F16L 55/02 |
| 2003/0115861 | A1 * | 6/2003 | Chang | F01N 1/006 60/323 |
| 2007/0261395 | A1 * | 11/2007 | Mahnken | F01N 1/165 60/297 |
| 2015/0354421 | A1 * | 12/2015 | Horr | F01N 1/166 181/241 |
| 2016/0333756 | A1 | 11/2016 | Hörr | |
| 2018/0252131 | A1 * | 9/2018 | Akrapovic | F01N 9/00 |
| 2019/0337377 | A1 * | 11/2019 | Herwat | F01N 1/166 |

FOREIGN PATENT DOCUMENTS

| | | | |
|---|---|---|---|
| CN | 206035615 | U | 3/2017 |
| CN | 106988830 | A | 7/2017 |
| DE | 27 06 957 | A1 | 8/1978 |
| DE | 201 20 470 | U1 | 4/2003 |
| DE | 10 2014 107 907 | A1 | 12/2015 |
| DE | 102014114254 | A1 | 3/2016 |
| DE | 10 2015 222 088 | A1 | 5/2017 |
| EP | 1380734 | A2 | 1/2004 |
| EP | 2 955 344 | A2 | 12/2015 |
| EP | 3 163 038 | A1 | 5/2017 |
| JP | 2005-256 736 | A | 9/2005 |
| JP | 2006-152 829 | A | 6/2006 |
| WO | 2008/150024 | A1 | 12/2008 |

* cited by examiner

MUFFLER

CROSS REFERENCE TO RELATED APPLICATIONS

This application claims the benefit of priority under 35 U.S.C. § 119 of German Application 10 2018 101 254.3, filed Jan. 22, 2018, and 10 2018 104 239.6 filed Feb. 26, 2018, the entire contents of which are incorporated herein by reference.

TECHNICAL FIELD

The present invention pertains to a muffler for an exhaust system of an internal combustion engine, for example, in a vehicle.

BACKGROUND

A muffler, in which an exhaust gas pipe group sending exhaust gas into a muffler housing and out of the muffler housing is provided, is known from DE 10 2015 222 088 A1. The exhaust gas pipe group of this prior-art muffler comprises an inlet pipe, which is open at a downstream inlet pipe end to an expansion chamber formed in the housing. A first outlet pipe is inserted with an upstream outlet pipe end area into the inlet pipe through an inlet pipe opening formed at the inlet pipe end and extends with its outlet pipe end area in the inlet pipe, so that the inlet pipe is open to the expansion chamber in the area of the inlet pipe opening via an intermediate space formed between the inlet pipe and the first outlet pipe. A second outlet pipe is open towards the expansion chamber at its upstream end located in the interior of the muffler housing. Exhaust gas introduced into the muffler housing via the inlet pipe leaves the muffler housing via the first outlet pipe and the second outlet pipe.

SUMMARY

An object of the present invention is to provide a muffler for an exhaust system of an internal combustion engine, especially for a vehicle, which has a low pressure loss and faint flow noises and can be adapted to the acoustic profile to be provided for an internal combustion engine in a simple manner.

This object is accomplished according to the present invention by a muffler for an exhaust system of an internal combustion engine, comprising a muffler housing and at least one exhaust gas pipe group, the at least one exhaust gas pipe group comprising:

- an outlet pipe, which is open to an expansion chamber formed in the muffler housing, wherein exhaust gas sent via the at least one exhaust gas pipe group leaves the muffler housing via the outlet pipe,
- a first inlet pipe, wherein the first inlet pipe has an inlet pipe end area, which is inserted into the outlet pipe and extends in the outlet pipe, and
- a second inlet pipe, wherein the second inlet pipe is open towards the expansion chamber.

Due to the adaptation of the length of the end area of the first inlet pipe, which said end area is inserted into the outlet pipe, efficient adaptation to a desired acoustic characteristic of such a muffler is possible in case of superimposition of the exhaust gas flows provided through the two inlet pipes. As an enlargement of the flow cross section does, in principle, take place in the transition from the first inlet pipe to the outlet pipe, an increase in flow resistance leading to flow noises and also to loss of output is avoided to the greatest extent possible.

To couple the outlet pipe to the expansion chamber, it is proposed that the outlet pipe have an outlet opening receiving the first inlet pipe at an upstream end of the outlet pipe and that the outlet pipe be open to the expansion chamber via an intermediate space formed between the outlet pipe and the first inlet pipe in the area of the outlet pipe opening.

As an alternative or in addition, provisions may be made

- for the outlet pipe to be open to the expansion chamber via at least one passage opening provided in a pipe wall of the outlet pipe, or/and
- for the first inlet pipe to be open to the expansion chamber via at least one passage opening provided in a pipe wall of the first inlet pipe, or/and
- for the first inlet pipe to be open to an intermediate space formed between the outlet pipe and the first inlet pipe via at least one passage opening provided in a pipe wall of the first inlet pipe.

To now prevent the discharge of exhaust gas fed via the first inlet pipe into the expansion chamber, but to guarantee, on the other hand, an efficient introduction of exhaust gas sent via the second inlet pipe into the expansion chamber into the outlet pipe, it is proposed that a plurality of passage openings be provided in the pipe wall, or/and that at least one passage opening and preferably each passage opening be provided in the area in which the inlet pipe end area extends.

For further influencing the acoustic characteristic, at least one additional chamber separated from the expansion chamber by a wall may be provided in the muffler housing. At least one opening establishing a connection between the expansion chamber and the additional chamber separated from this by the wall may now be provided in the wall. Further, the outlet pipe may be open to the additional chamber via at least one passage opening provided in a pipe wall of the outlet pipe.

The outlet pipe may comprise at least one and preferably two outlet pipe end pipes for the discharge of exhaust gas from the muffler housing. Such outlet pipe end pipes may also form at the same time the tail pipes of an entire exhaust system, via which the exhaust gas, optionally treated in one or more catalytic converter devices to reduce the pollutant emission, is discharged to the outside. However, a connection to an area of an exhaust system, which area is arranged downstream, for example, to another muffler, may, in principle, also be brought about via such outlet pipe end pipes.

For a stable connection, the first inlet pipe may be connected to the outlet pipe by

- at least one welded area, preferably slot weld area, or/and
- at least one disk-shaped connection element with at least one passage opening and preferably with a plurality of passage openings.

Further, a preferably exhaust gas-actuated exhaust flap may be provided in the first inlet pipe to influence the exhaust gas flow characteristics and hence also the acoustic characteristic.

The first inlet pipe and the outlet pipe may have a round cross-sectional geometry at least in their length areas in which they are inserted one into the other, at least one pipe of the inlet pipe and the outlet pipe having a circular cross-sectional geometry or/and at least one pipe of the first inlet pipe and the outlet pipe having a flattened round, preferably elliptical or oval cross-sectional geometry.

For an efficient guiding of exhaust gas and for avoiding losses of output in the internal combustion engine to the extent possible, two exhaust gas pipe groups may be provided especially for exhaust systems that are to be used in cooperation with larger internal combustion engines, in which case the outlet pipe and the second inlet pipe of a first of the exhaust gas pipe groups are open towards a first expansion chamber and the outlet pipe and the second inlet pipe of a second of the exhaust gas pipe groups are open towards a second expansion chamber. For example, the cylinders of an internal combustion engine may be divided into two groups, and one of the exhaust gas pipe groups may be assigned to each of these two groups of cylinders.

To make it possible to maintain a separation of the exhaust gas flows in the interior of the muffler housing as well, it is proposed that there be no exhaust gas exchange connection between the first expansion chamber and the second expansion chamber.

To set the acoustic profile of a muffler comprising two exhaust gas pipe groups, the first exhaust gas pipe group and the second exhaust gas pipe group may differ, for example, in

- the shape of the cross section or/and the size of the cross section of the outlet pipe or/and of the first inlet pipe,
- or/and
- the shape of the cross section or/and the size of the cross section of an intermediate space formed between the outlet pipe and the inlet pipe end area of the first inlet pipe,
- or/and
- the length of the inlet pipe end area extending in the outlet pipe,
- or/and
- the shape of the cross section or/and the size of the cross section of the second inlet pipe,
- or/and
- the number of outlet pipe end pipes,
- or/and
- the number or/and positioning or/and the size of passage openings provided in a pipe wall of the outlet pipe or/and in a pipe wall of the first inlet pipe.

The present invention further pertains to an exhaust system for an internal combustion engine, comprising a muffler having a configuration according to the present invention and, associated with the at least one exhaust gas pipe group, an exhaust gas duct system sending exhaust gas to the first inlet pipe and to the second inlet pipe. The exhaust gas discharged by an internal combustion engine is sent, optionally after flowing through one or more exhaust gas treatment devices to reduce the percentage of pollutants in the exhaust gas, to the muffler via the exhaust gas duct system.

It may also be made possible to additionally influence the acoustic characteristic during the operation of an internal combustion engine by the exhaust gas duct system comprising an exhaust flap in association with the first inlet pipe in at least one and preferably each exhaust gas pipe group. Such an exhaust flap comprises a flap diaphragm, which is adjustable, in general, by an electric motor-powered actuating drive, and which is adjustable, for changing the exhaust gas flow to the respective first inlet pipe, between a released position maximally releasing the exhaust gas flow and a closed position maximally throttling or preventing the exhaust gas flow and which may also have intermediate positions between the released position and the closed position for changing the acoustic characteristic essentially continuously.

To send exhaust gas to the two inlet pipes of a respective exhaust gas pipe group, it is proposed that in at least one and preferably in each exhaust gas pipe group, the exhaust gas duct system has an exhaust gas main line and a first exhaust gas branch line leading at a branching point from the exhaust gas main line to the first inlet pipe as well as second exhaust gas branch line leading from the exhaust gas main line to the second inlet pipe.

If the branching point has an exhaust gas flow regulating device and the exhaust gas flow into the first exhaust gas branch line and the exhaust gas flow into the second exhaust gas branch line are variable due to the exhaust gas flow regulating device, the acoustic characteristic can be influenced over a broader range by influencing the exhaust gas flow, i.e., the respective percentages of the total exhaust gas flow being sent through the two inlet pipes.

In case of such a configuration, the exhaust flap may be provided in the first exhaust gas branch line in at least one exhaust gas pipe group and preferably in each exhaust gas pipe group. The distribution of the partial exhaust gas flows sent through the respective inlet pipes and hence also the acoustic characteristic of the muffler can thus be influenced by the exhaust flap, on the one hand, and by the exhaust gas flow regulating device, on the other hand.

In another type of configuration, an exhaust flap may be provided in the first inlet pipe in at least one exhaust gas pipe group and preferably in each exhaust gas pipe group.

The present invention will be described below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
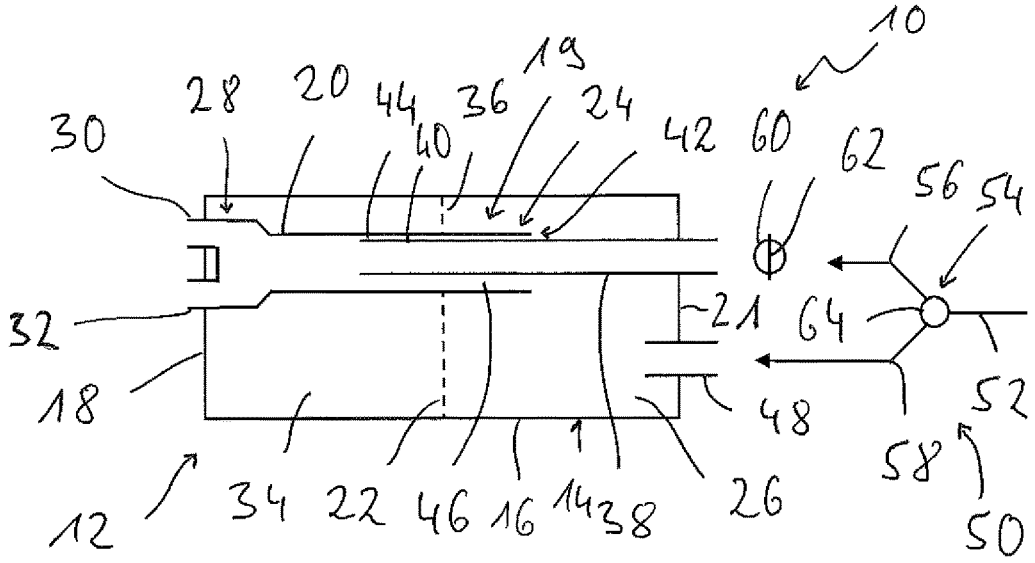
FIG. 1 is a schematic view of an exhaust system of an internal combustion engine with a muffler and with an exhaust gas duct system sending exhaust gas to the muffler.

Referring to the drawings, in a schematic view, FIG. 1 shows an exhaust system, generally designated by 10, for an internal combustion engine in a vehicle. The exhaust system 10 comprises as its essential component a muffler 12, which may be arranged, for example, as a rear muffler at an end area of an exhaust system generally in the rear area of a vehicle. The muffler 12 comprises an essentially cylindrically shaped muffler housing 14 with a, for example, circular cross section with a circumferential wall 16 and with a respective front wall 18, 21 each at the two longitudinal end areas thereof. To introduce and remove exhaust gas discharged from an internal combustion engine, the muffler 12 further has an exhaust gas pipe group generally designated by 19. The exhaust gas pipe group 19 comprises an outlet pipe 20, which may be carried at the front wall 18, on the one hand, and, for example, at an intermediate wall 22 arranged in the interior of the muffler housing 16, on the other hand. An upstream end 24 of the outlet pipe 20 is located in an expansion chamber 26 formed essentially between the front wall 21 and the intermediate wall 22. At a downstream end area 28, the outlet pipe 20 has two outlet pipe end pipes 30, 32, which pass through the front wall 18 and which may also be, for example, the tail pipes of the entire exhaust system 10, via which tail pipes 30, 32 the exhaust gas discharged from an internal combustion engine is released to the surrounding area. With its length area extending between the intermediate wall 22 and the front wall 18, the outlet pipe 20 extends essentially in another chamber 34, in which the branching of the outlet pipe 20 into the two outlet pipe end pipes 30, 32 may be provided as well. This branching could, in principle, also be arranged outside the chamber 34 or the muffler housing 14. The intermediate wall 22 separating the expansion chamber 26 from the other chamber 34 may be provided, as is shown, with a plurality of openings 36 in order to establish a connection between the two chambers 26, 34. The essential function of the intermediate wall 22 may be to provide a support for the outlet pipe 20.

The exhaust gas pipe group 19 further comprises a first inlet pipe 38. The first inlet pipe 38 is led through the front wall 21 into the interior of the muffler housing 14 and it passes through the expansion chamber 26. The first inlet pipe 38 is arranged such that it extends with an inlet pipe end area 40 through an outlet pipe opening 42 at the upstream outlet pipe end 24 and into the outlet pipe 20. The inlet pipe end area 40 thus forms the length area of the first inlet pipe 38, which said length area extends in the interior of the outlet pipe 20. The first inlet pipe 38 is open into the outlet pipe 20 at a downstream end 44. The outlet pipe 20 is, in turn, open to the expansion chamber 26 via an intermediate space 46 formed between the inlet pipe end area 40 and the outlet pipe 20.

A second inlet pipe 48 passes through the front wall 21 into the expansion chamber 26 and is open towards the expansion chamber 26. Thus, there also is, in principle, a flow connection between the second inlet pipe 48 and the outlet pipe 20 via the intermediate space 46.

To feed exhaust gas to the muffler 12 or to the two inlet pipes 38, 48, an exhaust gas duct system 50 shown only schematically in FIG. 1 is provided. This system comprises an exhaust gas main line 52, which is configured, for example, as a pipe and which is branched at a branching point 54 into a first exhaust gas branch line 56, which leads to the first inlet pipe 38 and is likewise configured, for example, as a pipe, and into a second exhaust gas branch line, which leads to the second inlet pipe 48 and which is likewise configured, for example, as a pipe. While the second exhaust gas branch line 58 may lead, for example, directly to the second inlet pipe 48, the first exhaust gas branch line 56 may lead via an exhaust flap 60 to the first inlet pipe 38. The percentage of the exhaust gas arriving via the exhaust gas main line 52, which percentage is fed to the first inlet pipe 38, may be changed by an adjustable flap diaphragm 62 of the exhaust flap 60. The flap diaphragm 62 may be able to be adjusted, for example, by an electric motor-powered actuator between an open position and a closed position, or it may be prestressed in the direction of the closed position and adjusted by the exhaust gas pressure from the closed position in the direction of the open position. The two exhaust gas partial flows being sent to the two inlet pipes 38, 48 may be additionally influenced by an exhaust gas regulating device 64 provided, e.g., at the branching point 54. This device can set, for example, the quantities of exhaust gas being sent to the respective exhaust gas branch lines 56, 58 by means of an adjustable flap, so that, for example, the entire exhaust gas flow may be sent over the second exhaust gas branch line 58 or the entire exhaust gas flow may be sent over the first exhaust gas branch line 56, or a percentage of the exhaust gas flow, whose quantity is adjustable, may be sent via each of these branch lines 56, 58. Due to the assembly units exhaust flap 60 and exhaust gas flow regulating device 64, which can also be actuated and hence adjusted during the operation of an internal combustion engine, it is possible to influence the acoustic characteristic of the muffler 12 during the operation based on the fact that the exhaust gas flows can be varied thereby.

Another influence on the acoustic characteristic of a muffler, which influence is to be specified in the design of the muffler 12, can be achieved by the interaction of the first inlet pipe 38 with the outlet pipe 20. The depth of insertion of this inlet pipe into the outlet pipe 20 and also the shape of the cross section and the dimension of the cross section of the intermediate space 46 formed between the inlet pipe end area 40 and the outlet pipe 20 have a substantial influence on the acoustic characteristic of the muffler 12. Since there is an expansion of the flow cross section in the area in which the exhaust gas being sent via the first exhaust gas branch line 56 leaves the first inlet pipe 38 and enters the outlet pipe 20, throttling, which could compromise the output of an internal combustion engine, also fails to occur in this area.

The depth of insertion of the first inlet pipe 38 into the outlet pipe 20 could also be selected, for example, such that the first inlet pipe 38 ends in the area in which the expansion chamber extends. A flow connection could also be achieved or additionally achieved between the outlet pipe 20 and the expansion chamber 26 by a plurality of passage openings, through which the percentage of exhaust gas flow being sent via the second inlet pipe 48 into the expansion chamber 26 can flow into the outlet pipe 20, being provided in a pipe wall of the outlet pipe 20. To now prevent exhaust gas being introduced via the first inlet pipe 38 from flowing through such passage openings into the expansion chamber 26, such passage openings are preferably positioned in the length area of the outlet pipe 20 in which the inlet pipe end area 40 extends, so that exhaust gas leaving the inlet pipe 38 enters into the area of the outlet pipe 20 in which no such passage openings are provided. Since it shall further be ensured that the exhaust gas being fed via the first inlet pipe 48 is not discharged, in principle, to the expansion chamber 26, the first inlet pipe 38 has no passage openings establishing a direct flow connection to the expansion chamber 26 in its pipe wall in its length area passing through the expansion chamber 26, especially also in its length area extending outside the outlet pipe 20, so that the first inlet pipe acts as a simple through pipe.

It should further be noted that more partitions may, of course, also be provided to influence the acoustic characteristic of the muffler 12 and these may be positioned at a different location or/and the muffler housing 16 may be lined with sound-insulating material, for example, fiber material, at least in some areas.

Figure 2:
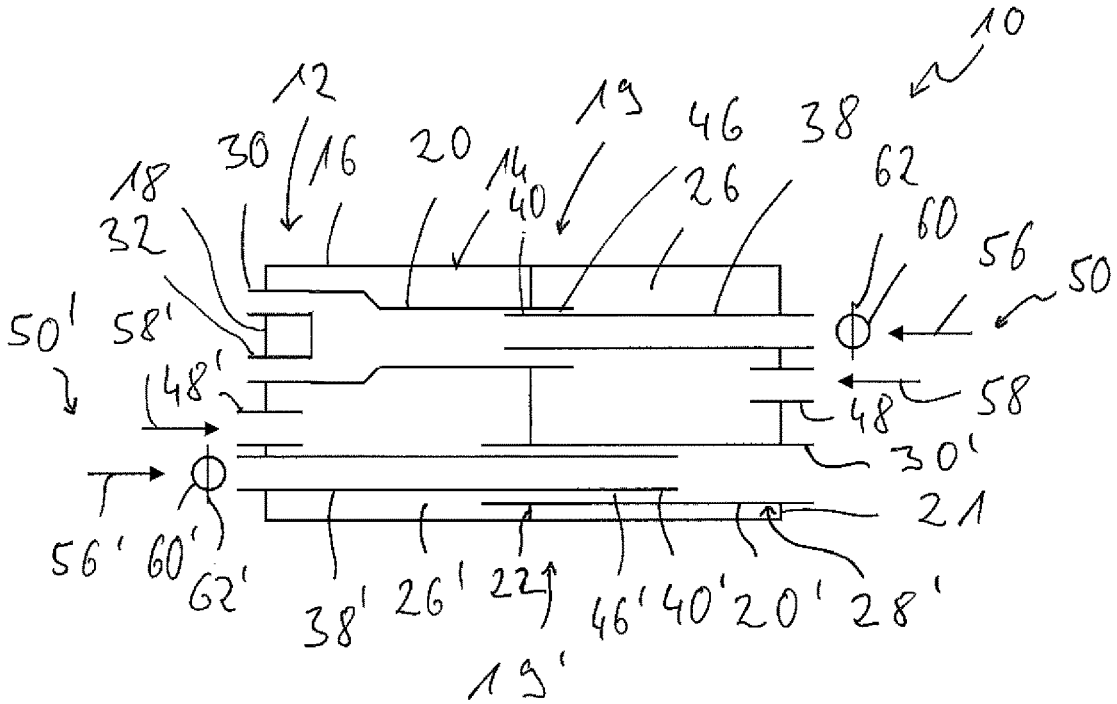
FIG. 2 is a schematic view, corresponding to that in FIG. 1, of an alternative type of configuration of an exhaust system and of a muffler provided therefor.

An alternative type of configuration is shown in FIG. 2. This utilizes, in principle, the configuration principles that were explained above with reference to FIG. 1 and to the exhaust gas pipe group 19 shown there, but it has, contrary to the type of configuration according to FIG. 1, two such exhaust gas pipe groups 19, 19'. The exhaust gas pipe group 19 of the type of configuration shown in FIG. 2 may correspond in terms of its design and function essentially to the exhaust gas pipe group 19 of the type of configuration shown in FIG. 1. This also applies to the exhaust gas duct system 50 with its two exhaust gas branch lines 56, 58 and with the exhaust flap 60 provided in the first exhaust gas branch line, which system 50 is shown only partially in FIG. 2 and is assigned to the first exhaust gas pipe group 19.

The second exhaust gas pipe group 19' shown in FIG. 2 also comprises an outlet pipe 20', which is carried on the partition 22, on the one hand, and on the front wall 21, on the other hand. Unlike the outlet pipe 20 of the first exhaust gas pipe group 19, the outlet pipe 20 of the second exhaust gas pipe group 19' has only one exhaust gas pipe end pipe 30', which is provided essentially by the downstream end area 28' thereof and which is passed, for example, through the front wall 21. The first inlet pipe 38' of the second exhaust gas pipe group 19' extends through the front wall 18 and extends with its inlet pipe end area 40' in the upstream part of the outlet pipe 20' of the second exhaust gas pipe group 19'.

An exhaust gas duct system 50', which may be configured, in principle, like the exhaust gas duct system 50 provided in association with the first exhaust gas pipe group 19 and may have a first exhaust gas branch line 56' as well as a second exhaust gas branch line 58', is associated with the second exhaust gas pipe group 19'. For example, the exhaust gas duct systems 50, 50' associated with the two exhaust gas pipe groups 19, 19' may cooperate with respective different groups of cylinders of an internal combustion engine or send the exhaust gas discharged by these cylinders to the respective exhaust gas pipe groups 19, 19' of the muffler 12.

To functionally uncouple the two exhaust gas pipe groups 19, 19' from one another, the partition 22 is preferably configured without openings in the exemplary embodiment shown in FIG. 2, so that a separate expansion chamber 26 or 26' is formed in association with each exhaust gas pipe group 19, 19' in the muffler housing 14, and there is no exhaust gas exchange connection between the two expansion chambers 26, 26'.

In the configuration shown in FIG. 2, the two exhaust gas pipe groups 19, 19' can also cooperate in different manners concerning the acoustic characteristic especially in the interaction of the respective first inlet pipe 38, 38' with the outlet pipe 20, 20'. Thus, as is shown in FIG. 2, the depth of insertion of the respective first inlet pipe 38, 38' into the outlet pipe 20, 20' may be different. The relative positioning at right angles to the direction of the longitudinal extension may also be selected differently. In addition, it is possible to select the shape of the cross section or/and the dimension of the cross section of the first inlet pipes 38, 38' differently, just as the shape of the cross section or/and the dimension of the cross section of the respective outlet pipes 20, 20'. The second inlet pipes 48, 48' may also be selected differently in terms of the shape of the cross section or/and the dimension of the cross section. It should be noted here that if the dimension of the cross section is referred to, this may designate, for example, the cross-sectional area through which flow can take place or, in case of a circular configuration, the internal diameter or the inner radius of the respective pipes involved.

Figure 3:
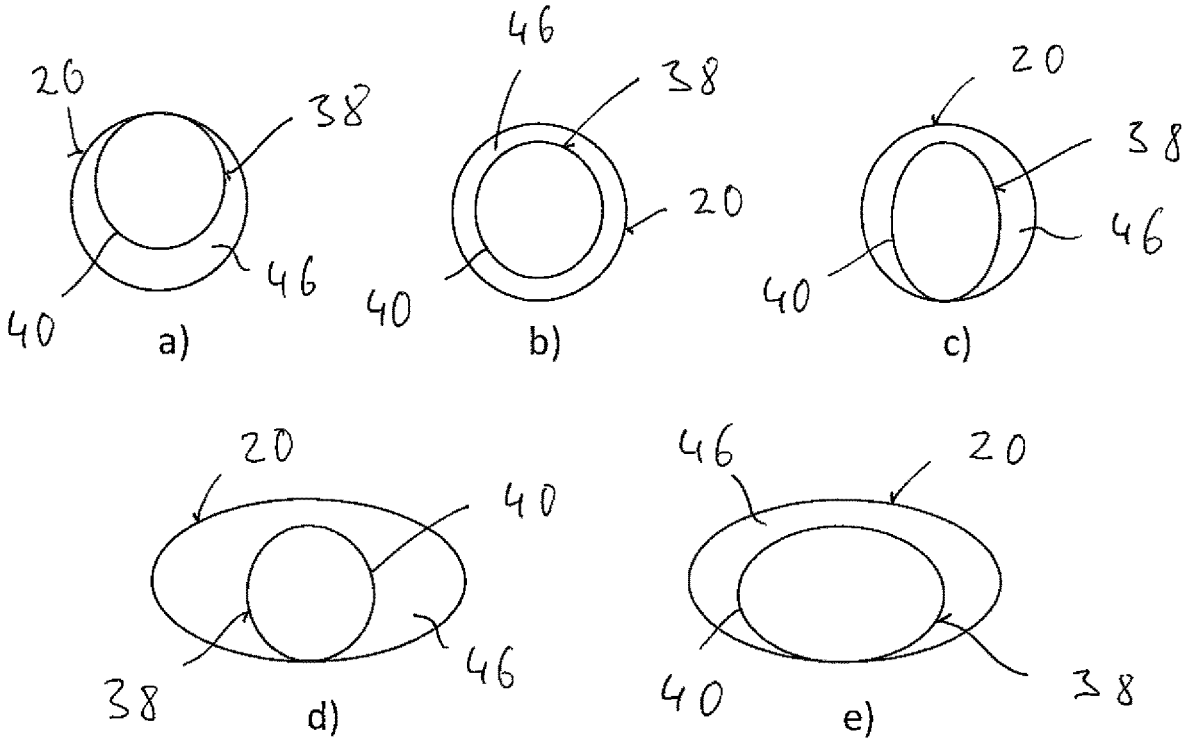
FIG. 3 is a view showing different cross-sectional shapes a), b), c), and e) of a first inlet pipe of a muffler according to FIG. 1 or FIG. 2, which said inlet pipe is inserted into an outlet pipe.

In its views a)-e), FIG. 3 shows different possibilities of how the interaction of the first inlet pipe 38 with the outlet pipe 20 can be varied. It should be noted that this also pertains, of course, to the interaction of the first inlet pipe 38' with the outlet pipe 20' of the second exhaust gas pipe group 19' in the configuration according to FIG. 2.

FIG. 3*a*) shows that the two pipes 20, 38 pushed one into the other may be provided each with a circular cross-sectional shape and the first inlet pipe 38 with its inlet pipe end area 40 may be arranged eccentrically in relation to a central longitudinal axis of the outlet pipe 20, for example, it may touch the circumferential wall of the outlet pipe 20 with its circumferential wall and can be fixed to same, for example, by connection in substance, e.g., welding or soldering. The intermediate space 46 formed between these two pipes 38, 20 thus has an essentially sickle-shaped form.

The two pipes 20, 38 configured with round, especially circular cross-sectional geometry in the type of configuration shown in FIG. 3*b*) are arranged concentrically to one another, so that the intermediate space 46 has an essentially circular ring-shaped configuration. Such a concentric arrangement of pipes configured, for example, with an elliptical cross-sectional geometry is possible as well.

FIG. 3*c*) shows an exemplary embodiment, in which the outlet pipe 20 is configured with a circular cross-sectional shape at least in its length section receiving the first inlet pipe 38 or the inlet pipe end area 40 thereof or in a part of said length section, while the inlet pipe end area 40 may be configured with a cross-sectional shape differing from a circular cross-sectional shape, for example, with an elliptical or oval cross-sectional shape. The configuration could, of course, also be such here that the outlet pipe 20 has a geometry different from a circular cross-sectional shape, while the inlet pipe end area 40 is provided with a circular or, for example, likewise non-circular cross-sectional shape. The two pipes 20, 38 touch each other in a circumferential area, so that they may be connected to one another, as will be explained below, in this area of mutual contact.

In the exemplary embodiment shown in FIG. 3*d*), the outlet pipe 20 has, at least in its length area receiving the end area 40 of the first inlet pipe 38, a round, elliptical cross-sectional geometry, while the first inlet pipe 38 has a circular cross-sectional geometry in its end area 40 extending in the outlet pipe 20. The two pipes 20, 38 touch each other in a circumferential area in this exemplary embodiment as well, but they may also be arranged such that the first inlet pipe 38 is also arranged centered in the vertical direction in the outlet pipe 20.

FIG. 3*e*) shows an embodiment of the two pipes 38, 20 with a respective flattened round, for example, elliptical cross-sectional geometry, and the two pipes 20, 38 touch each other mutually in a circumferential area here as well, especially in areas with the respective greatest radius of curvature.

Figure 4:
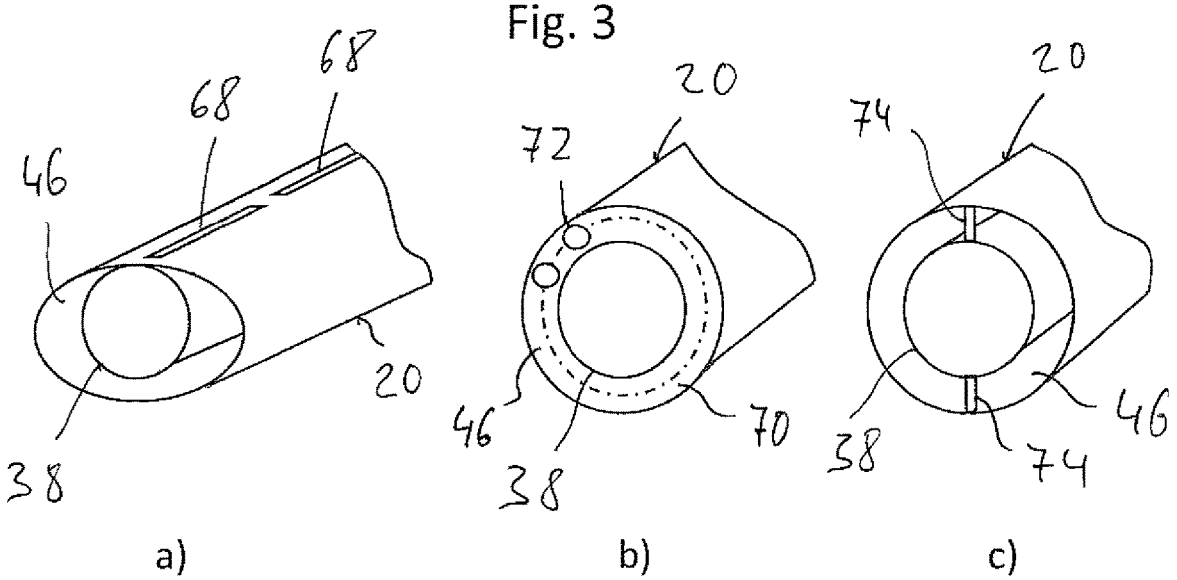
FIG. 4 is a view showing different connection types a), b) and c) of an outlet pipe to a first inlet pipe.

FIG. 4 shows different possibilities of the mutual connection of the pipes 20, 38. Thus, FIG. 4*a*) shows the connection of the pipes 20, 38 configured with the cross-sectional geometry shown in FIG. 3*d*). In their areas in which they are mutually in contact with one another, the pipes 20, 38 are connected to one another in a plurality of slot weld areas 68 following one another, for example, in the longitudinal direction of the pipe. A plurality of slots, which follow each other, e.g., in the longitudinal direction of the pipe, may be provided for this in the pipe wall of the outlet pipe 20. They may be welded to one another through these slots or along the contact line of the two pipes 20, 38.

In the type of connection shown in FIG. 4*b*), the two pipes 20, 38 may be connected to one another by one or more ring-shaped disks 70 arranged in the intermediate space 46. In particular, such a disk 70 may be provided at the upstream end of the outlet pipe 20, at the location at which the first inlet pipe 38 enters this end and may be fixed by welding at both the outlet pipe 20 and the first inlet pipe 38. As is indicated by a dash-dotted line, a plurality of passage openings, which follow each other in the circumferential direction and which provide a connection between the intermediate space 46 and the expansion chamber 26, are provided in the disk 70.

FIG. 4*c*) shows the connection of the two pipes 20, 38 with the use of connection elements 74 in the form of rods or bolts. These may be fixed on the outer circumference of the first inlet pipe 38 and on the inner circumference of the outlet pipe 20 by, for example, welding. It should be noted that more than two connection elements 74 in the form of rods or bolts may be provided distributed over the circumference and in the longitudinal direction of the pipe. These may also be elongated in a plate-like manner especially in the longitudinal direction of the pipe and hence also in the exhaust gas flow direction and may have, for example, a profiling in the form of a drop or bearing surface.

Figure 5:
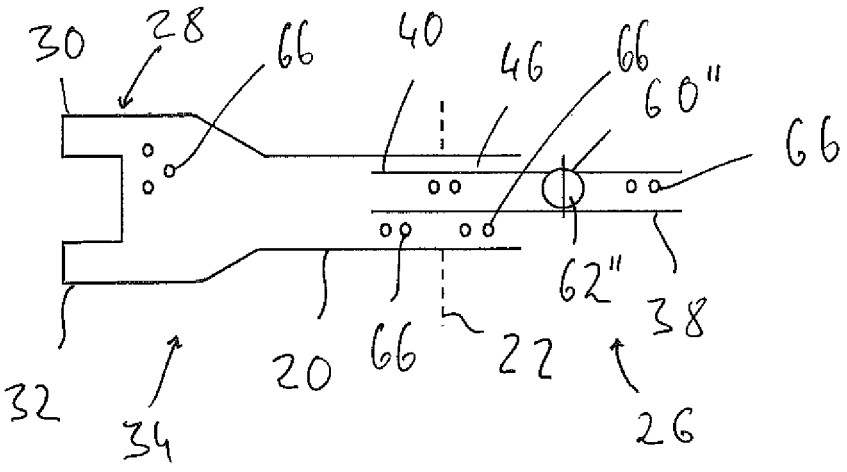
FIG. 5 is a schematic detail view showing the muffler of FIG. 1 with alternative configuration aspects.

FIG. 5 shows design variants of the outlet pipe 20 and of the first inlet pipe 38 inserted into same. It should be noted that the design variants explained below may be embodied in themselves or in any combination in the muffler shown in FIG. 1 as well and also in one or both of the exhaust gas pipe groups 19, 19' shown in FIG. 2.

FIG. 5 shows that passage openings 66 may be provided in different positions in the respective pipe wall in the outlet pipe 20 or/and in the first inlet pipe 38. Thus, such passage openings 66, via which the first inlet pipe 38 is open towards the expansion chamber 26, may be provided in the first inlet pipe 38 in the length area thereof, which extends outside the outlet pipe 20 but in the expansion chamber 26. Passage openings, via which the intermediate space 46 is open towards the expansion chamber 26, may also be provided in the outlet pipe 20 in the area thereof that extends in the expansion chamber 26. The outlet pipe 20 may also be provided with passage openings 66 in its length area extending in the additional chamber 34. These passage openings may be provided, for example, in the length area of the outlet pipe 20, in which the end area 40 of the first inlet pipe 38 extends, so that the intermediate space 46 is open towards the additional chamber 34 via such passage openings 66. Such passage openings may also be provided in other length areas of the outlet pipe 20, which extend in the area of the additional chamber 34. Thus, FIG. 5 shows passage openings 66 in the downstream end area 28 of the outlet pipe 20 at a location where this has an approximately Y-shaped form and passes over into the two tail pipes 30, 32.

It should be stressed that such passage openings 66 provided in different areas of the pipes 20, 38 may differ in terms of their grouping density or/and their cross-sectional geometry or/and their size. Such passage openings may be provided in respective identical positions and with the same shape or size in the two exhaust gas pipe groups 19, 19' in the exemplary embodiment shown in FIG. 2 as well. As an alternative, the two exhaust gas pipe groups 19, 19' may differ in terms of the number or/and size or/and shape or/and positioning of such passage openings 66.

Another configuration aspect shown in FIG. 5 is the provision of an exhaust flap 60 or of an adjustable flap diaphragm 62 thereof in the first inlet pipe 38, preferably in the length area of said inlet pipe extending in the muffler housing 14. Since this area is accessible only poorly for a motor actuation of the flap diaphragm 62, such a configuration of the exhaust flap 60, in which the flap diaphragm 62 is prestressed, for example, by a spring into a closed position and can be adjusted by the exhaust gas pressure in the first inlet pipe 38 in the direction of an open position, is suitable here.

It should also be noted concerning the provision of such an exhaust flap 60 in the interior of the muffler 12 that such a configuration can be embodied in one or both exhaust gas pipe groups 19, 19' of the configurations shown in FIG. 2. Such a passive exhaust flap 60 could also be provided in the first inlet pipe 38 in the interior of the muffler 12 in one of the two exhaust gas pipe groups 19, 19', while an exhaust flap 60 shown in FIG. 2 could be provided outside the muffler in the exhaust gas duct system and could be actuated, for example, by an electric motor in the other of the two exhaust gas pipe groups 19, 19'.

It becomes possible due to the configuration according to the present invention of a muffler especially in the interaction of an inlet pipe with an outlet pipe receiving same to vary the acoustic characteristic or the acoustic profile of a muffler in a broad range and thus to provide a desired acoustic profile for an internal combustion engine. This can be supported by the fact that the respective partial flows of the exhaust gas released by an internal combustion engine, which flows are fed in a first inlet pipe and in a second inlet pipe, can already be influenced in the exhaust gas feed, so that a basic acoustic profile can be predefined by the design configuration of the muffler, on the one hand, and, on the other hand, this basic acoustic profile can be varied by acting on an exhaust flap or/and an exhaust gas flow regulating device depending on the operation.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

a muffler housing defining an expansion chamber; and at least one exhaust gas pipe group comprising:

an outlet pipe open to the expansion chamber, wherein exhaust gas introduced via the at least one exhaust gas pipe group leaves the muffler housing via the outlet pipe;

a first inlet pipe with an inlet pipe end area inserted into the outlet pipe and extending a distance in the outlet pipe; and a second inlet pipe open to the expansion chamber.

2. A muffler in accordance with claim 1, wherein:

the outlet pipe has an outlet pipe opening receiving the first inlet pipe at an upstream end of the outlet pipe; and the outlet pipe is open to the expansion chamber in an area of the outlet pipe opening via an intermediate space formed between the outlet pipe and the first inlet pipe.

3. A muffler in accordance with claim 1, wherein:

the outlet pipe is open to the expansion chamber via at least one passage opening provided in a pipe wall of the outlet pipe; or the first inlet pipe is open to the expansion chamber via at least one passage opening provided in a pipe wall of the first inlet pipe; or the first inlet pipe is open to an intermediate space formed between the outlet pipe and the first inlet pipe via at least one passage opening provided in a pipe wall of the first inlet pipe; or any combination of the outlet pipe is open to the expansion chamber via at least one passage opening provided in a pipe wall of the outlet pipe and the first inlet pipe is open to the expansion chamber via at least one passage opening provided in a pipe wall of the first inlet pipe and the first inlet pipe is open to an intermediate space formed between the outlet pipe and the first inlet pipe via at least one passage opening provided in a pipe wall of the first inlet pipe.

4. A muffler in accordance with claim 3, wherein:

a plurality of passage openings are provided in the pipe wall of the outlet pipe; or at least one passage opening is provided in an area in which the inlet pipe end area extends; or a plurality of passage openings are provided in the pipe wall of the outlet pipe and at least one passage opening is provided in an area in which the inlet pipe end area extends.

5. A muffler in accordance with claim 1, further comprising a wall provided in the muffler housing, wherein the muffler housing defines the expansion chamber and an additional chamber separated from the expansion chamber by the wall.

6. A muffler in accordance with claim 5, wherein:

at least one opening separated is provided in the wall to establish a connection between the expansion chamber and the additional chamber; or the outlet pipe is open to the additional chamber via at least one passage opening, the at least one passage opening being provided in a pipe wall of the outlet pipe; or the at least one opening separated is provided in the wall to establish a connection between the expansion chamber and the additional chamber and the outlet pipe is open to the additional chamber via at least one passage opening, the at least one passage opening being provided in a pipe wall of the outlet pipe.

7. A muffler in accordance with claim 1, wherein the outlet pipe comprises two outlet pipe end pipes for discharging of exhaust gas from the muffler housing.

8. A muffler in accordance with claim 1, wherein:

the first inlet pipe is connected to the outlet pipe by at least one slot weld area; or the first inlet pipe is connected to the outlet pipe by at least one disk connection element with at least one passage opening; or the first inlet pipe is connected to the outlet pipe by at least one connection element comprising a rod; or any combination of the first inlet pipe is connected to the outlet pipe by at least one slot weld area and the first inlet pipe is connected to the outlet pipe by at least one disk connection element with at least one passage opening and the first inlet pipe is connected to the outlet pipe by at least one connection element comprising a rod.

9. A muffler in accordance with claim 1, further comprising an exhaust gas pressure-actuated exhaust flap provided in the first inlet pipe.

10. A muffler in accordance with claim 1, wherein:

the first inlet pipe and the outlet pipe have a round cross-sectional geometry at least in a length area in which the first inlet pipe and the outlet pipe are inserted one into the other wherein at least one pipe of the first inlet pipe and the outlet pipe has a circular cross-sectional geometry; and/or at least one pipe of the first inlet pipe and the outlet pipe has a flattened round, elliptical or oval cross-sectional geometry.

11. A muffler in accordance with claim 1, further comprising: a wall provided in the muffler housing, wherein the muffler housing defines the expansion chamber and an additional expansion chamber separated from the expansion chamber by the wall; another exhaust gas pipe group comprising another outlet pipe, another first inlet pipe with an inlet pipe end area inserted into the another outlet pipe and extending a distance in the another outlet pipe and another second inlet pipe, wherein: the outlet pipe and the second inlet pipe of said at least one exhaust gas pipe group are open to the expansion chamber; and the another outlet pipe and the another second inlet pipe of the another exhaust gas pipe group are open to the additional expansion chamber.

12. A muffler in accordance with claim 11, wherein there is no exhaust gas exchange connection between the first expansion chamber and the additional expansion chamber.

13. A muffler in accordance with claim 12, wherein the exhaust gas pipe group and the additional exhaust gas pipe group differ from one another as to:

a shape of a cross section or/and a size of the cross section of the outlet pipe or/and of the first inlet pipe; or/and a shape of a cross section or/and in a size of the cross section of an intermediate space formed between the outlet pipe and the inlet pipe end area; or/and a length of an inlet pipe end area extending in the outlet pipe; or/and a shape of a cross section or/and a size of the cross section of the second inlet pipe; or/and a number of outlet pipe end pipes; or/and a number or/and positioning or/and size of passage openings provided in a pipe wall of the outlet pipe or/and in a pipe wall of the first inlet pipe.

14. An exhaust system for an internal combustion engine, the exhaust system comprising: an exhaust gas duct system; and a muffler comprising a muffler housing defining an expansion chamber and at least one exhaust gas pipe group comprising an outlet pipe open to the expansion chamber, wherein exhaust gas introduced via the at least one exhaust gas pipe group leaves the muffler housing via the outlet pipe, a first inlet pipe with an inlet pipe end area inserted into the outlet pipe and extending a distance in the outlet pipe; and a second inlet pipe open to the expansion chamber, wherein the exhaust gas duct system sends exhaust gas to the first inlet pipe and to the second inlet pipe.

15. An exhaust system in accordance with claim 14, wherein the exhaust gas duct system comprises an exhaust flap associated with the first inlet pipe.

16. An exhaust system in accordance with claim 14, wherein the exhaust gas duct system comprises an exhaust gas main line and a first exhaust gas branch line leading at a branching point from the exhaust gas main line to the first inlet pipe and a second exhaust gas branch line leading from the exhaust gas main line to the second inlet pipe.

17. An exhaust system in accordance with claim 16, wherein the exhaust gas duct system further comprises a branching point comprising an exhaust gas flow regulating device, wherein the exhaust gas flow into the first exhaust gas branch line and the exhaust gas flow into the second exhaust gas branch line can be changed by the exhaust gas flow regulating device.

18. An exhaust system in accordance with claim 15, wherein the exhaust flap is provided in the first exhaust gas branch line.

19. An exhaust system in accordance with claim 14, wherein an exhaust flap is provided in the first inlet pipe.

20. A muffler for an exhaust system of an internal combustion engine, the muffler comprising: a muffler housing defining an expansion chamber; an outlet pipe passing through said muffler housing and having an opening inside said expansion chamber; a first inlet pipe passing through said muffler housing with an inlet pipe end area inserted into said outlet pipe and extending a distance into said outlet pipe; and a second inlet pipe passing through said muffler housing and opening to said expansion chamber.

* * * * *